United States Patent [19]

Lonati

[11] 4,454,729

[45] Jun. 19, 1984

[54] CIRCULAR KNITTING MACHINE OF THE CYLINDER AND DIAL TYPE, IN PARTICULAR FOR KNITTING HOSIERY

[75] Inventor: Francesco Lonati, Brescia, Italy

[73] Assignee: Lonati S.p.A., Brescia, Italy

[21] Appl. No.: 373,950

[22] Filed: May 3, 1982

[30] Foreign Application Priority Data

May 8, 1981 [IT] Italy ..... 21597 A/81

[51] Int. Cl.[3] ..... D04B 9/06; D04B 15/92

[52] U.S. Cl. ..... 66/28; 66/95; 66/149 S

[58] Field of Search ..... 66/28, 95, 149 S

[56] References Cited

U.S. PATENT DOCUMENTS

| | | | |
|---|---|---|---|
| 1,361,291 | 12/1920 | Stibbe | 66/95 |
| 1,459,446 | 6/1923 | Fenn | 66/28 X |
| 1,461,693 | 7/1923 | Bromley et al. | 66/28 |
| 3,516,268 | 6/1970 | Foreman | 66/149 S |
| 4,339,932 | 7/1982 | Lonati | 66/28 |

FOREIGN PATENT DOCUMENTS

| | | | |
|---|---|---|---|
| 2609101 | 10/1976 | Fed. Rep. of Germany | 66/95 |
| 6701147 | 8/1967 | Netherlands | 66/28 |
| 2035390 | 6/1980 | United Kingdom | 66/149 S |

*Primary Examiner*—Wm. Carter Reynolds

*Attorney, Agent, or Firm*—Guido Modiano; Albert Josif

[57] ABSTRACT

A circular knitting machine, in particular for knitting hosiery, is disclosed, wherein the dial is rotated by the needle cylinder through a rod extending coaxially with the cylinder and dial and rotatively connected to the latter. The rod can be shifted axially from a position of engagement with a drive element rigid with the cylinder, to a position of disengagement therefrom, and vice-versa. In the former condition, the dial will be rotated in timed relationship with the cylinder, whereby the fabric is knitted normally, whereas in the latter condition, the knitted fabric is discharged. The rod axial movement may be obtained by pneumatically or hydraulically operated cylinder, whose piston is rotatably connected to the rod itself. It is further possible to make the dial raisable vertically through a pneumatic or hydraulic cylinder, such as to make the loop formation area fully accessible.

8 Claims, 6 Drawing Figures

CIRCULAR KNITTING MACHINE OF THE CYLINDER AND DIAL TYPE, IN PARTICULAR FOR KNITTING HOSIERY

BACKGROUND OF THE INVENTION

This invention relates to a circular knitting machine of the cylinder and dial type, in particular for knitting hosiery.

More specifically, the invention concerns a circular knitting machine, wherein the needle cylinder and the dial are made rotatively rigid together through a coupling means located within the cylinder, said means comprising a rod coaxial with the cylinder and dial and rotatively connected to the dial, as well as rotatively engageable and disengageable with/from the cylinder, said means being shaped to allow the discharge of the knitted fabric when said rod is at least partly disengaged from the cylinder.

A machine of this general type is described in U.K. Published Application No. 2,035,390 A to Costruzioni Meccaniche Lonati S.p.A, corresponding to U.S. Pat. No. 4,339,932 to Francesco Lonati. In the latter machine, the rod extends through the whole needle cylinder up to a point beyond the bottom end thereof, and for cylinder engaging/disengaging, a rotary sleeve element is provided below the cylinder, the sleeve element being axially movable relatively to the needle cylinder and also having a means operative to engage with a matching means respectively provided on the rod. The axial displacement of the sleeve element, which is accomplished by means of a lever located on the machine outside, e.g. one controlled by the machine own program, involves mutual engagement or disengagement of the cylinder and dial.

The knitted fabric, upon completion, is discharged after the connection between the sleeve element and rod has been released. The knitted fabric discharge may be effected in two stages, namely by first bringing the fabric into the sleeve element and maintaining the rotary connection between the sleeve element and rod at the bottom end of the sleeve element, and then releasing this connection to simultaneously establish a connection at the top end of the sleeve element, whereby the fabric is allowed to drop out or be sucked out of the sleeve element; alternatively, the sleeve element may be simply disengaged from the rod in one step, such as to create a direct pathway for fabric discharging. In the latter case, the dial would be rotatively disengaged from the cylinder as the knitted fabric is being discharged, but this has no influence on the fabric because it would be already released from the needles. Upon re-establishing the connection, suitable indices on the sleeve element and rod would ensure the resetting of the exact cylinder to dial angular relationship.

In a machine of this type, therefore, the dial is no longer rotated through gears of its own to be driven by the machine main drive, but rather through the cylinder. Thus, a constant angular relationship is maintained between the cylinder and dial during rotation which cannot be always obtained with conventional machines, owing to the gear teeth being liable to wear rapidly, such that after a time an accurate alignment of the dial needles and cylinder needles can no longer be ensured, with obvious attendant defects in the knitted fabric.

A further advantage of a circular knitting machine of this type is the simplified construction of the portion overlying the dial, wherein it is no longer necessary to provide any rotary drive members.

By constrast, a machine of this type, particularly in the embodiment thereof which provides for a two-stage discharge of the fabric, has proved to be more complex internally at the portion underlying the cylinder, and owing to the need to operate the fabric discharge step simultaneously with mechanical operations in addition to the traditional knitwork sucking out step.

SUMMARY OF THE INVENTION

A primary object of this invention is to further improve on a machine as described above, so as to simplify the construction of the mechanisms for rotary engagement and disengagement of the cylinder and dial, especially as regards the fabric discharge step.

A further object of this invention is to provide a circular knitting machine as indicated, which can facilitate the full inspection of the needle knitting area, without interfering with the cylinder to dial connection arrangement.

These and other objects, such as will be apparent hereinafter, are achieved by a circular knitting machine as specified in the preamble, characterized in that the rod is axially shiftable with respect to the needle cylinder and dial between a position of engagement with, and a position of disengagement from, a drive element made rotatively and axially rigid with said cylinder, while maintaining the rotary engagement with said dial.

In a machine of this type, no rotary sleeve element is provided because the engagement and disengagement actions are simply accomplished by an axial displacement of the rod itself, said displacement being obtainable, for example, by arranging a fixed pneumatic or hydraulic cylinder above the dial, whose piston is rotatably connected to said rod. It follows that the whole structure of the machine can be made simpler. Moreover, the simple disengagement of the rod from the element made rotatively and axially rigid with the cylinder automatically creates a pathway for discharging the knitted fabric, which can, therefore, be discharged at a faster rate. The exact angular position is quite simply ensured between the cylinder and dial by a mating geometric configuration of the parts intended to be mutually engaged. Thanks to the rod mobility, it is also possible to arrange for the dial to be movable linearly along a vertical direction, while preferably maintaining its rotary engagement with the rod, thereby it can be moved to a position sufficiently away from the cylinder to enable the needle working area to be easily inspected. Advantageously, this vertical displacement movement may also be accomplished through pneumatic or hydraulic means.

BRIEF DESCRIPTION OF THE DRAWINGS

Further details and advantages of the invention will become apparent from the following detailed description of two preferred embodiments thereof, given herein by way of example only in conjunction with the accompanying drawings, where.

DESCRIPTION OF THE PREFERRED EMBODIMENTS

Figure 1:
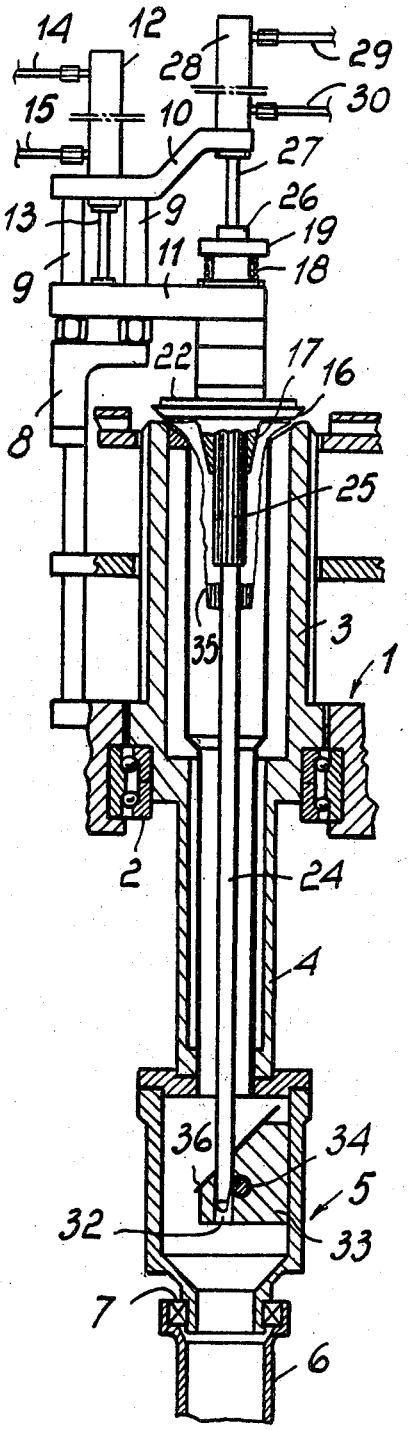
FIG. 1 is a partly sectional elevation view of a machine according to the invention, shown in accordance with a first embodiment thereof, and during its normal knitting operation step.
Figure 3:
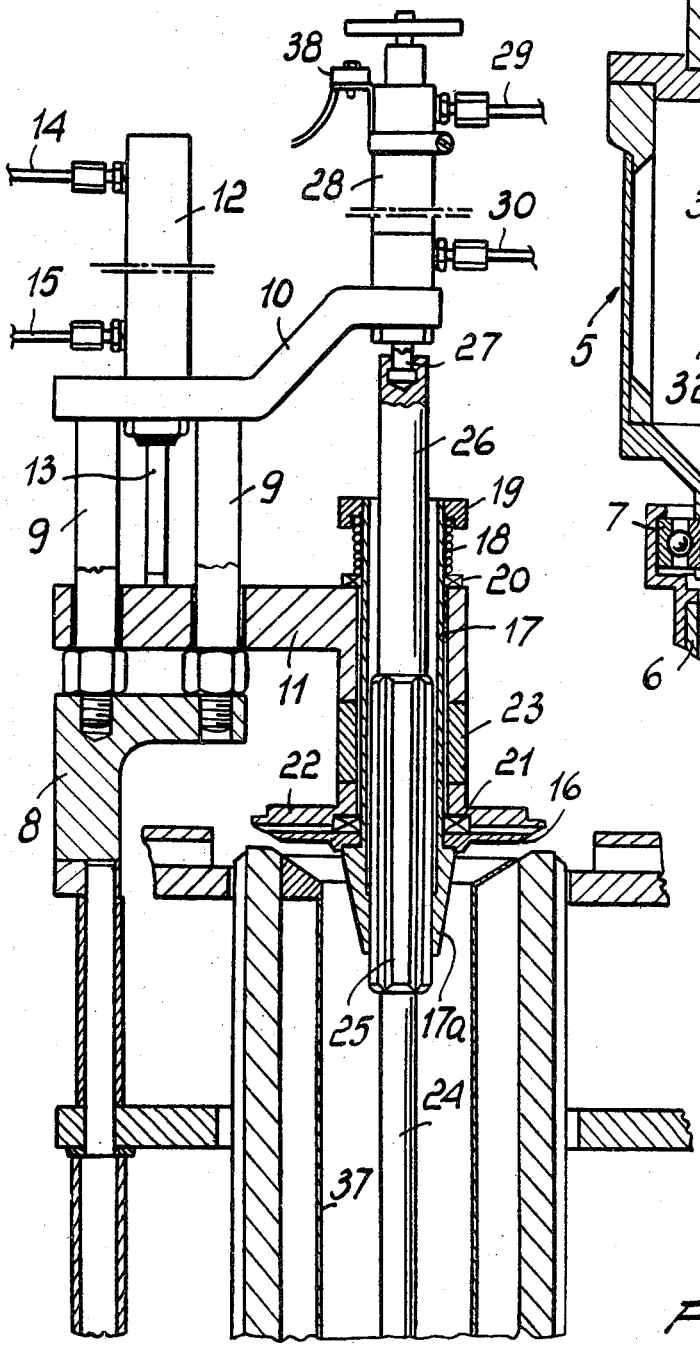
FIG. 3 is a partly sectional elevation view of the top portion of the machine of FIG. 1, shown on an enlarged scale in its position of knitted fabric discharge.
Figure 4:
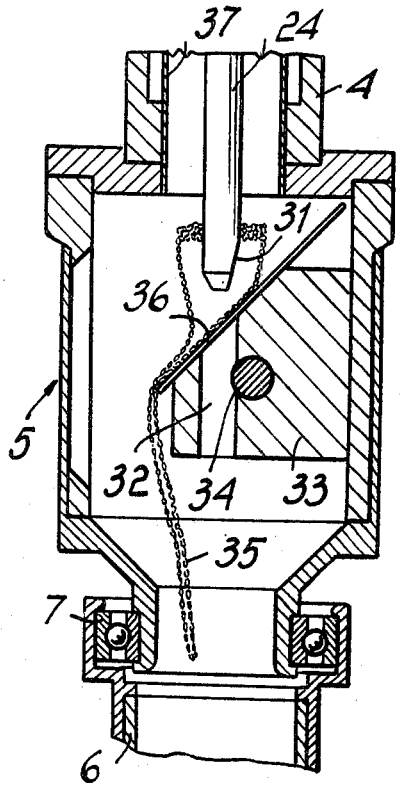
FIG. 4 is a sectional view through the bottom portion of the machine of FIG. 1, shown on an enlarged scale during the knitted fabric discharge step.

Making initial reference to FIGS. 1,3 and 4, a circular knitting machine according to the invention, in particular for knitting hosiery, comprises, in accordance with a first embodiment thereof, a fixed or stationary structure 1 which carries a needle cylinder 3 rotatable in bearings 2. The needle cylinder 3 extends downwardly into a tubular element 4 which supports a discharge box 5, also arranged to rotate with the cylinder 3. At the bottom of the box 5 there is provided a non-rotating discharge tube 6, which is connected to the box 5 through bearings 7 and communicates to a suction vacuum source, not shown, for sucking out the knitwork in a manner known per se.

To the stationary structure 1 there is attached a support 8 which supports two parallel uprights 9 extending in a vertical direction, and accordingly parallel to the axis of the cylinder 3. The uprights 9 carry, at their top ends, a fixed arm 10, which extends substantially radially with respect to the machine. Along the uprights 9, a supporting arm 11 is slidably mounted which also extends substantially radial to the machine and is driven by means of a pneumatically or hydraulically operated cylinder 12, fastened to the arm 10, the piston of which cylinder has a rod 13 which extends parallel to the uprights 9 and is connected to the supporting arm 11. The cylinder 12 is connected, through lines 14 and 15 and valve means, not shown, alternately to a source of pressurized fluid and to an exhaust system, not shown. The delivery of pressurized fluid through either of lines 14 and 15, enables a controlled vertical displacement of the arm 11, as will be explained hereinafter.

The arm 11 rotatably carries a dial 16, which is arranged coaxially with the cylinder 3, through a hollow substantially cylindrical supporting body 17, which supports the dial 16 coaxially and rigidly from below, and is in turn held at the top by a spring 18 stretched between a plate 19, adjustably secured on the support body 17, and a bearing 20 carried on the arm 11. The spring 18 urges the dial 16, through the support body or holder 17, against bearings 21 which separate rotationwise the dial 16 from a fixed cover 22 which carries, in a manner known per se, the cams controlling the needles or hooks in the dial 16, the dial, therefore, being in turn urged against the arm 11 with the interposition of a cylindrical spacer element 23. Thus, by shifting the arm 11 vertically as described above, the dial 16 is also moved vertically, as may be required for checking purposes or for cleaning operations within the loop formation area. In normal operating conditions, the pressure of the fluid in the cylinder 12 will keep the arm 11, and consequently the dial 16, at a stable lower position.

The dial 16 is driven rotatively through the cylinder 3 by a coupling means located inside the cylinder 3 and comprising a rod 24 coaxial with the cylinder and dial, which rod 24 is rotatively connected to the dial through a prismatic coupling means defined by a grooved body 25 being rigid with the rod 24 and in engagement with a mating grooved configuration of the interior of a lower conical portion 17*a* of the support body 17. This type of coupling allows the rod 24 to be shifted axially while retaining its rotary engagement with the dial 16. The prismatic coupling advantageously extends over a length which is at least equal to the axial displacement extent of the rod 24.

The rod 24 has a top portion 26 of increased diameter, which is connected to the rod 27 of a piston movable within a pneumatic or hydraulic cylinder 28 attached to the arm 10 and lying coaxially with the rod 24. The connection between the portion 26 of rod 24 and rod 27 is preferably a fixed one, while the connection between the rod 27 and related piston is of the rotatable type, such as to allow the piston to slide within the fixed cylinder 28 without hindering the rotation of the rod 24. The cylinder 28 is connected, through lines 29 and 30 and valve means, not shown, alternately to a source of pressurized fluid and to an exhaust, thereby the rod 24 is enabled to move up and down in a programmed way between two extreme positions, one of which being a position of coupled relationship with the cylinder 3 for rotation therewith, the other being a position of disengagement from the cylinder 3.

To this end, the lower or bottom end of the rod 24 is formed with a bevel 31 on one side, and is insertable through a hole 32 formed in an entrainment element 33 so attached to the box 5 as to be rotatively and axially rigid with respect to the cylinder 3. As visible in the drawings, the entrainment element 33 extends across the axis of the needle cylinder 3 and dial 16. A pin 34, extending perpendicularly to the rod 24 and protruding with its lateral surface into the hole 32, is also arranged in the entrainment element 33. At the extreme bottom position of the rod 24, the bevel 31 on the rod 24 engages the pin 34, thus making said rod 24 rigid with the entrainment element 33 and hence with the cylinder 3 for rotation therewith, said engagement being ensured and stabilized by the pressure acting on the piston in the cylinder 28. Thus, the dial 16 is caused to rotate through the cylinder 3, in a constant angular relationship therewith about a common axis, during normal knitting, as shown in FIG. 1.

At the other extreme position of the rod 24, that is the top position (FIG 3), the rod 24 is disengaged from the entrainment element 33 (FIG. 4), thus uncovering a discharge pathway for the knitted fabric 35 which has been formed around the rod 24 itself. In order to allow the knitted fabric 35 to be discharged, the entrainment element 33 is formed at the top with an inclined surface 36 which extends across the axis of the needle cylinder 3 and directs the fabric downwardly.

Advantageously, within the cylinder 3 and related extension 4, a guiding tube 37 may be provided for the fabric 35, which tube would extend as far as the discharge box 5.

The length of the rod 24 between the portion which rotatively engages with the dial 16 and entrainment element 33 is preferably slightly longer than the knitted fabric 35 expected to be knitted. However, it may be made shorter, since it is possible for the knitwork to gather at the entrainment element 33 before it is discharged.

Advantageously, a microswitch 38 may be provided to automatically operate the machine as the rod 24 is brought into its bottom position of engagement with the entrainment element 33, or to automatically stop the machine in the event that the rod 24 is raised out of its bottom position of engagement with the entrainment element 33.

Figure 2:
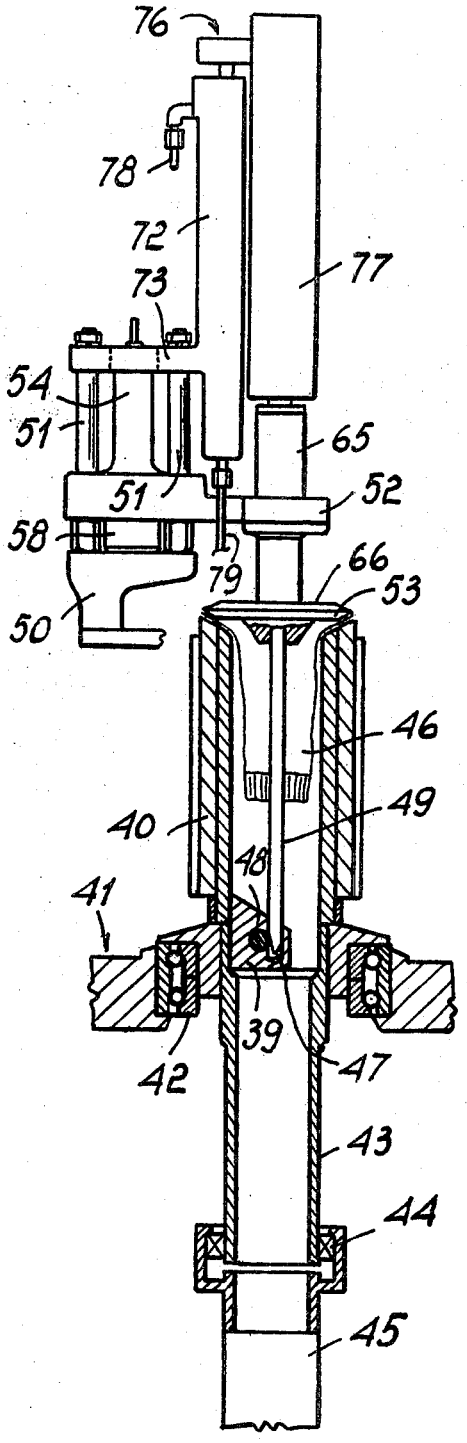
FIG. 2 is a partly sectional elevation view of a second embodiment of an inventive machine, also shown during its normal knitting operation step.
Figure 6:
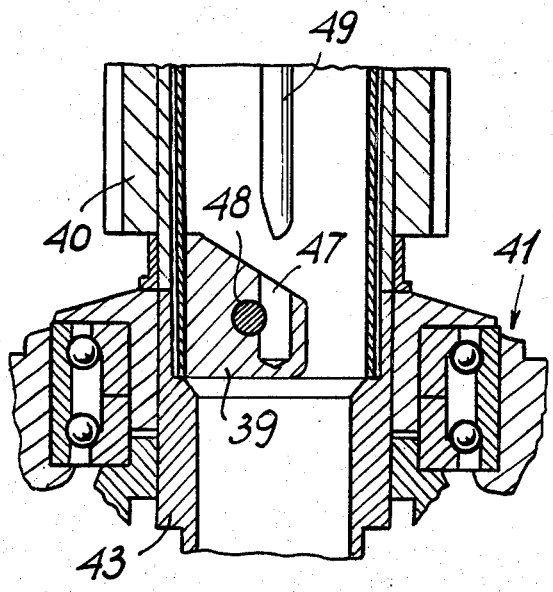
FIG. 6 is a sectional view through the middle portion of the machine of FIG. 2, shown on an enlarged scale during the knitted fabric discharge step.
Figure 5:
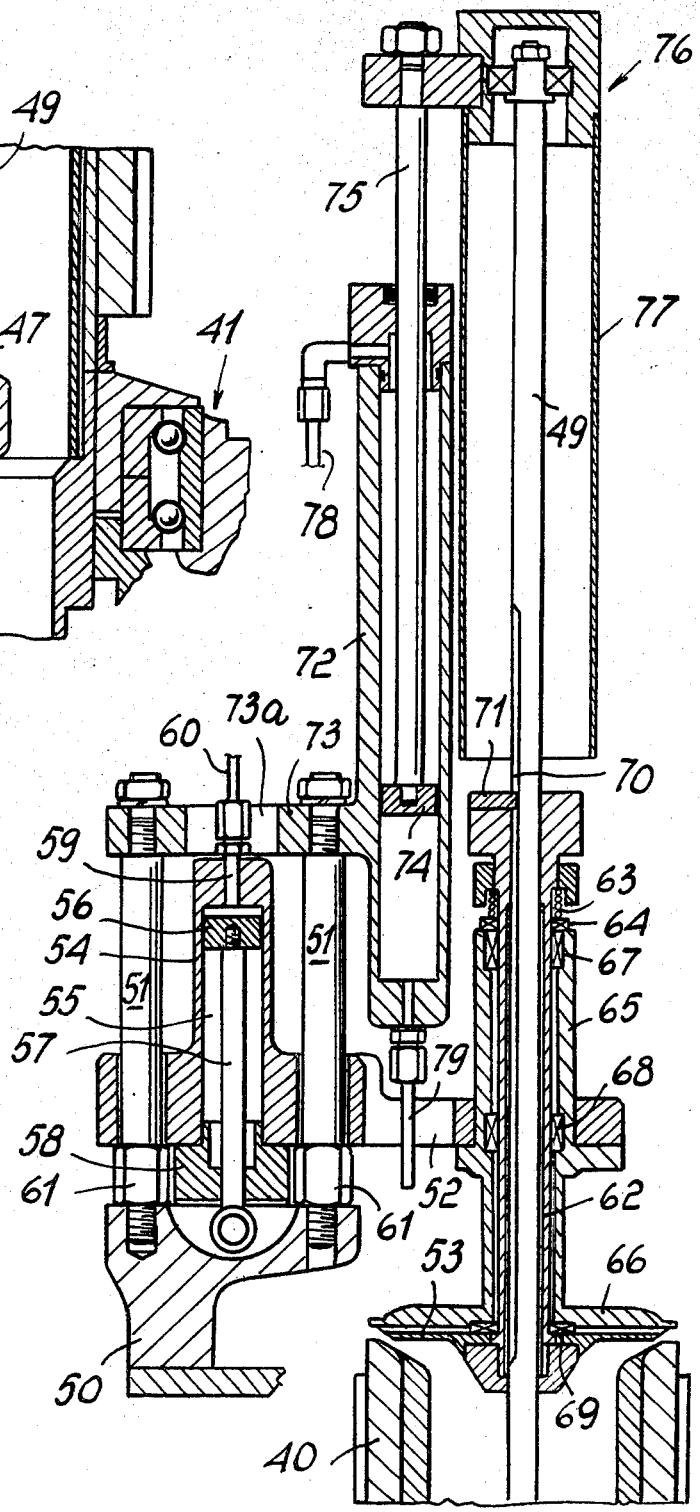
FIG. 5 is a sectional view of the top portion of the machine of FIG. 2, shown on an enlarged scale during the knitted fabric discharging step at the end of the knitting operation.

FIGS. 2,5 and 6 illustrate another embodiment of the machine according to this invention, wherein the entrainment element 39 is arranged within the needle cylinder 40, at the lower portion thereof. The cylinder 40 is carried rotatably on a stationary portion 41 of the machine through bearings 42 and extends into a tubular element 43. To the tubular element 42 there is connected, through bearings 44, a discharge tube 45 for the knitted fabric 46. The entrainment element 39, which extends across the axis of the needle cylinder 40 and is formed at the top with an inclined surface also extending across the axis of the needle cylinder 40 for discharging the knitted fabric, has a hole 47 and pin 48 for engagement with a bevelled bottom end of a rod 49, being the equivalent of the rod 24 in the first embodiment of the invention. The engagement is effected in the same manner as described with reference to the first embodiment, except that the hole 47 is a blind hole rather than a through hole.

In the embodiment shown in FIGS. 2,5 and 6, a stationary portion 50 of the machine supports two uprights 51 which are parallel to each other and to the machine axis, along which uprights an arm 52 is slidable which extends substantially radially with respect to the cylinder 40 and rotatably carries a dial 53, as explained hereinafter. The arm 52 has, located between the two uprights 51, a cylindrical protuberance 54, wherein a chamber 55 is defined which accommodates a piston 56 having its rod 57 attached to the stationary portion 50. The chamber 55 is closed at the bottom by a closure or shutter body 58, attached to the arm 52, and communicates at the top, through a throughgoing hole 59 in the protuberance 54 and a conduit 60, with a pressure source, not shown. By supplying a pressurized fluid into the chamber 55 above the piston 56, the arm 52 is caused to move upwardly, thereby the dial 53 is lifted vertically to provide access to the loop formation area. The downward movement is produced in this case by the structure own weight, to bring the arm 52, in the normal operating condition of the machine, close against two nuts 61, whereby the uprights 51 are respectively fastened to the stationary portion 50. The dial 53 is secured to a hollow support body 62, of substantially cylindrical configuraion, which is carried, through a spring 63 and bearings 64, on a sleeve 65 attached to the arm 52 coaxially with the cylinder 40. The sleeve 65 is a part of a fixed cover 66 of the dial which accommodates the control cams for the dial needles or hooks. The support body 62 is centered within the sleeve 65 and with respect to the cover 66 by bearings 67,68 and 69, thereby the dial 53 is also coaxial with the cylinder 40.

At the support body 62, the rod 49 has on its lateral surface a longitudinally extending groove 70, whereinto a tooth 71, attached to the support body 62, engages for rotary engagement of the rod 49 with the dial 53, while allowing a relative axial sliding movement between the rod and dial. Of course, both the groove 70 and tooth 71 should be precision machined to prevent any relative angular movements between the rod 49 and dial 53.

For the axial displacement of the rod 49 between its two extreme positions, respectively corresponding to the position of engagement with the entrainment element 39 (FIG. 2) and position of disengagement therefrom (FIG. 6), there is provided a pneumatic or hydraulic unit which comprises a cylinder 72 having a lug 73 attached to the top of the uprights 51 and formed with an opening 73*a* for the passage of the protuberance 54. In the cylinder 72, a piston 74 is slidable whose rod 75 is attached, on the outside of the cylinder 72, to a structure 76 carrying the rod 49 rotatably. Advantageously, between the bearing structure 76 and support body 62, a protective tube 77 is provided. The cylinder 72 is connected, on either sides of the piston 74, and through conduits or lines 78 and 79 and valve means not shown, alternately to a pressurized fluid source and to an exhaust. The delivery of pressurized fluid into the region overlying the piston 74 allows the engagement of the rod 49 with the entrainment element 39 to be maintained under pressure action. The delivery of pressurized fluid to the region underlying the piston 74 produces the lifting thereof into the position shown in FIG. 5, and hence the disengagement of the rod 49 from the entrainment element 39 (FIG. 6). In comparison to the embodiment shown in FIGS. 1, 3 and 4, the latter embodiment has the advantage of reducing the overall height dimension of the machine.

It will be appreciated from the foregoing description that both the above embodiments provide a rotary connection between the cylinder and dial in a most simple manner and at the expense of a very moderate constructional complexity. In fact, there are no longer provided gear drives for rotating the dial, nor a sleeve element movable axially within the cylinder (or tubular element rotating therewith) and controllable from the outside. In both the embodiments the dial is supported to be movable vertically independently from the vertical rod 24 or 49 which serves for the rotatory connection of the dial to the needle cylinder. The axial displacement of the rod which connects the cylinder to the dial enables the arrangement of a pneumatic or hydraulic unit coaxial or parallel with the rod, thereby simplifying the connection between the stationary parts and rotatable or axially displaceable parts. The pneumatic or hydraulic drive, moreover, readily lends itself to automation, in that it only requires programmed actuation of solenoid valves.

The invention as described is susceptible to many modifications and variations without departing from the scope of the instant inventive concept. Thus, as an example, engagement means could be provided between the rod 24 or 49 and the respective entrainment element 33 or 39 different from those shown, e.g. of the prismatic type. Of course, it would also be possible to provide a machine having its top portion configured as shown in FIG. 1 and its bottom portion as shown in FIG. 2, or viceversa.

I claim:

1. A circular knitting machine of the cylinder and dial type, particularly for knitting hosiery, comprising a coupling means between the needle cylinder and the dial for rotation of said dial with said needle cylinder about a common axis, said coupling means comprising a rod coaxial with said needle cylinder and said dial and rotatively connected to said dial and an entrainment element rotatively and axially rigid with said needle cylinder for rotatively connecting said rod with said needle cylinder, wherein said entrainment element extends across said axis and said rod is axially shiftable with respect to said needle cylinder and said dial between a position of engagement with, and a position of disengagement from, said entrainment element while maintaining rotary engagement with said dial.

2. A knitting machine according to claim 1, further comprising a fluid-operated cylinder having a piston rotatably connected to said rod for axially shifting said rod.

3. A knitting machine according to claim 2, wherein said fluid-operated cylinder is arranged coaxially with said rod.

4. A knitting machine according to claim 1, comprising, between said rod and said dial, a prismatic coupling defined by a grooved body rigid with said rod and by a portion rigid with said dial and having an interior mating grooved configuration for engagement with said grooved body.

5. A knitting machine according to claim 4, wherein said prismatic coupling extends over a length at least equal to the axial displacement extent of said rod.

6. A knitting machine according to claim 1, wherein said rod has a bottom end having a bevel on one side and said entrainment element has a hole formed therein for receiving said bottom end, said entrainment element further having a pin extending substantially perpendicularly to said rod for engagement with said bevel to cause rotary engagement between said entrainment element and said rod.

7. A knitting machine according to claim 1, wherein said entrainment element has an upper inclined surface extending across said axis for discharging a knitted fabric.

8. A knitting machine as claimed in claim 1, wherein said dial is supported to be movable vertically independently from said rod.

* * * * *